US006702862B1

(12) United States Patent
Izumi

(10) Patent No.: US 6,702,862 B1
(45) Date of Patent: Mar. 9, 2004

(54) METHOD AND APPARATUS FOR STABILIZING CLOTH, AND METHOD OF MANUFACTURING CLOTH

(75) Inventor: Takeshi Izumi, Ehime (JP)

(73) Assignee: Shikokuizumisenni, LTD, Ehime-ken (JP)

( * ) Notice: Subject to any disclaimer, the term of this patent is extended or adjusted under 35 U.S.C. 154(b) by 0 days.

(21) Appl. No.: 09/601,100

(22) PCT Filed: Jan. 25, 1999

(86) PCT No.: PCT/JP99/00305

§ 371 (c)(1),
(2), (4) Date: Jul. 27, 2000

(87) PCT Pub. No.: WO99/37846

PCT Pub. Date: Jul. 29, 1999

(30) Foreign Application Priority Data

Jan. 27, 1998 (JP) ..... 10/030582
Jun. 30, 1998 (JP) ..... 10/201266

(51) Int. Cl.[7] ..... D06B 1/04

(52) U.S. Cl. ..... 8/149.1; 08/151; 08/158; 68/5 D; 68/5 C; 68/205 R

(58) Field of Search ..... 68/5 D, 5 C, 5 E, 68/202, 205 R; 8/151, 149.1, 158

(56) References Cited

U.S. PATENT DOCUMENTS 1,723,514 A * 8/1929 Klein
1,876,739 A * 9/1932 Pearce
1,947,106 A * 2/1934 Plumstead
2,293,154 A * 8/1942 Lovett
2,294,141 A * 8/1942 Trimble
2,442,277 A * 5/1948 Reeve
2,479,358 A * 8/1949 Hoffman
2,509,464 A * 5/1950 Weinpel
2,539,947 A * 1/1951 De Klerk
2,645,837 A * 7/1953 Robbins
3,038,777 A * 6/1962 Daul et al.
3,045,461 A * 7/1962 Saito
3,173,752 A * 3/1965 Powell et al.
3,199,317 A * 8/1965 Walsh
3,350,160 A * 10/1967 Davis et al.
3,390,950 A * 7/1968 Delforge
3,426,556 A * 2/1969 Rutter
3,457,029 A * 7/1969 Drago
3,462,978 A * 8/1969 Hill
3,494,718 A * 2/1970 Wilson (List continued on next page.)

FOREIGN PATENT DOCUMENTS

GB 2016545 * 9/1979
GB 2092191 * 8/1982

(List continued on next page.)

OTHER PUBLICATIONS

Euorpean Patent Office 533,631 Mar. 1993.*

*Primary Examiner*—Frankie L. Stinson
(74) *Attorney, Agent, or Firm*—Westerman, Hattorri, Daniels & Adrian, LLP

(57) ABSTRACT

A method for stabilizing a cloth comprises a moisture controlling step S1 of adding water to the cloth and a thermal pressing step S2 of thermally pressing the water-added cloth. The water added in the moisture controlling step is vaporized to cover up the entire cloth and therefore the cloth can be heated uniformly. When temperature of the cloth increases, the moisture works as a lubricant, enabling to release internal stress of the cloth efficiently. By thermally pressing, a structure of the cloth under the heated state is fixed by the pressure applied in the pressing operation, making possible to stabilize the cloth while preventing excessive shrinkage of the cloth and increasing smoothness of cloth surfaces.

31 Claims, 12 Drawing Sheets

FOREIGN PATENT DOCUMENTS

| | | | | |
|---|---|---|---|---|
| 3,640,099 | A | * | 2/1972 | Holm |
| 3,672,819 | A | * | 6/1972 | Katsuyama et al. |
| 3,681,951 | A | * | 8/1972 | Chaikin et al. |
| 3,762,187 | A | * | 10/1973 | Fleissner et al. |
| 3,762,188 | A | * | 10/1973 | Bernholz et al. |
| 4,005,230 | A | * | 1/1977 | Fleissner |
| 4,030,320 | A | * | 6/1977 | Riedel |
| 4,176,531 | A | * | 12/1979 | Fleissner |
| 4,430,779 | A | * | 2/1984 | Rockman et al. |
| 4,718,257 | A | * | 1/1988 | Reinehr et al. |
| 4,776,186 | A | | 10/1988 | Riedel |
| 5,546,622 | A | * | 8/1996 | McAlister et al. |
| 5,575,048 | A | * | 11/1996 | Ruef |
| 5,580,410 | A | * | 12/1996 | Johnston |

FOREIGN PATENT DOCUMENTS

| | | | | |
|---|---|---|---|---|
| GB | 2152085 | | * | 7/1985 |
| JP | 60-6473 | Y2 | | 3/1985 |
| JP | 61-152806 | A | | 7/1986 |
| JP | 3629963 | A1 | | 3/1988 |
| JP | 63-66370 | A | | 3/1988 |
| JP | 2-175964 | A | | 7/1990 |
| JP | 4-125499 | | * | 4/1992 |
| JP | 4-202841 | A | | 7/1992 |
| JP | 5-339806 | A | | 12/1993 |
| JP | 6-228858 | A | | 8/1994 |
| JP | 8-209516 | A | | 8/1996 |

* cited by examiner

METHOD AND APPARATUS FOR STABILIZING CLOTH, AND METHOD OF MANUFACTURING CLOTH

TECHNICAL FIELD

The present invention relates to a method for stabilizing a woven, knitted or other cloth, an apparatus for stabilizing the same, and a method for manufacturing the same.

BACKGROUND ART

A woven, knitted or other cloth for a sewing purpose undergoes a number of processes such as spinning, weaving or knitting, degumming, breaching, dying, and so on, before becoming the final product. During these processes, an individual fiber or yarn is forced to stretch or shrink. Part of the stretch or shrinkage appears as permanent dimensional change whereas the rest stays latent within the cloth as residual strain. When sewn, if the cloth is moistened or heated for ironing or thermally bonding an interlining cloth, then the residual strain is released, appearing as dimensional change, namely stretch and/or shrinkage, often resulting in a wrinkle or distortion in the cloth.

A reason for this is presumably that the moisture, heat and so on make inside of the cloth lubricated and swollen, promoting interaction among different forces such as partial release of the internal stress of the fiber, change in molecular movement, change in molecular cluster structure, change in fiber aggregate structure and so on, allowing the fiber or the yarn to return to a state of stabilization. In order to eliminate the stretch and shrinkage during or after the sewing process, a variety of dimension stabilizing treatments are performed before the interlining-cloth bonding process or the sewing process.

For example, a sponging treatment disclosed in the Japanese Patent Laid-Open No. 6-228858 is one of the dimension stabilizing treatments mentioned above. The sponging treatment has been a mainstream of the dimension stabilizing treatments for a variety of cloths.

The sponging treatment disclosed in the above gazette is a combination of steaming treatment and steam-pressing treatment, and is considered to reduce an amount of dimensional change such as shrinkage and stretch during the interlining-cloth bonding process and intermediate/finish pressing process.

In the interlining-cloth bonding process, in which the stretch and shrinkage of the cloth is most intense, the cloth and the interlining cloth are heated up to about 130° C. in general so as to melt a thermally plastic binder on an bonding boundary surface. Thereafter, the cloth and the interlining cloth are pressed to bond together.

In recent years, with an increasing diversity in the cloth material, there is an increasing diversity in weaving structure and so on. Further, density of the cloth often varies from place to place. For these reasons, it is difficult to heat an entire cloth uniformly.

In such a case as above, in order to attain a guaranteed lowest temperature of a surface to be bonded with the interlining cloth, temperature of the heater is often increased. However, if the temperature of the heater is increased, inconsistency develops in heating temperature, and the cloth near the heater is subjected to a high temperature, which often exceeds 150° C.

Under such a temperature condition as above, the cloth develops significant stretch and/or shrinkage even after the sponging treatment as disclosed in the above gazette. Thus, the cloth must be pre-cut in an over size, and then re-cut into a desired size after the interlining cloth is bonded. This leads to a problem that a significantly increased number of steps must be necessary.

Even if the interlining cloth is not bonded, the cloth is often finish-pressed or ironed at a temperature of 140° C. or higher. If the cloth is subjected to such a high temperature even for a short time, the cloth develops significant shrinkage and/or stretch even after treated by the prior art sponging treatment, often resulting in a product with flaw such as a wrinkle.

Further, in the conventional stabilizing apparatus as described above, the cloth which is like a long ribbon is wound around a number of rollers while each of the steps as described above is performed. This means that the operations are made to the cloth which is under tension, and dimension stabilizing effect cannot be achieved sufficiently.

DISCLOSURE OF THE INVENTION

It is therefore an object of the present invention to provide a method for stabilizing the cloth, an apparatus for stabilizing the cloth, and a method for manufacturing the cloth capable of solving the above problems, thereby stabilizing the size of the cloth to be bonded with the interlining cloth, to be finish-pressed or otherwise treated, as well as eliminating the development of the wrinkle and so on.

A method for stabilizing cloth according to the present invention comprises a moisture controlling step of adding water to the cloth, and a thermal pressing step of pressing the water-added cloth under heat, and further, each of the steps is performed while the cloth is supported on a belt running horizontally.

Generally, when the interlining cloth is thermally bonded in the interlining-cloth bonding process, pressing operation is usually performed under dry and hot condition. Further, in order to make sure that the entire surface to bond to the interlining cloth is maintained at a temperature higher than a melting temperature of the thermally plastic binder, the whole cloth is maintained at a high temperature for a predetermined time and then the pressing is made by a roller. Therefore, a surface of the cloth near the heater is subjected to thermal load greater than a temperature necessary for the bonding. The inventor of the present invention discovered that during the interlining-cloth bonding process or the finish-pressing process after sewing, the surface of the cloth is subjected to a temperature much higher than the temperature applied in the conventional sponging treatment and so on, and the pressing operation is performed under this high temperature. Another finding was that during these steps, moisture in the cloth is significantly reduced from a normal amount contained under temperature and humidity conditions of a room where the cloth is being treated.

The inventor of the present invention confirmed that if the cloth is pre-treated under conditions reflecting the temperature and humidity used in the above interlining-cloth bonding process and so on, the cloth does not overly stretch or shrink even when the interlining-cloth bonding process is performed by heating the whole cloth at a temperature higher than 150° C., and came to the invention of a method for stabilizing cloth according to the present application.

By adding moisture, it becomes possible to reduce friction thereby increase lubrication among fibers or yarns of the cloth. Further, it becomes possible to prevent damage to the texture of the cloth and deterioration in mechanical characteristics of the cloth caused by a high thermal load applied in a thermal pressing step to be described later. The moisture controlling step can be performed by spraying water to the cloth, or spraying steam from a boiler for example, to the cloth.

If no moisture is added, thermal conductivity decreases, making difficult to stabilize the cloth, increasing possibility for damage to the cloth when the cloth is heated to a temperature necessary for the stabilization.

There is no specific limitation to an amount of moisture to be added; however, it is preferable to allow the cloth to contain an amount of moisture at least greater than normally contained therein at a temperature of a room where the stabilization is performed. If the amount of moisture is less than normally contained, the cloth may be damaged when heated. In order to obtain dimension stabilizing effect, the amount of moisture to be added should be 5% or less of a weight of the cloth under the normal condition. Further, the effect can be expected in most of the cloths by adding 2% through 4% of moisture.

The cloth stretches/shrinks when added with even a small amount of moisture. Therefore, even the moisture controlling step is performed while supporting the cloth on a belt running horizontally, making sure that no extra stress is caused in the cloth.

In the thermal pressing step, the cloth added with water is pressed under heat. In order to obtain desired dimension stabilizing effect, it is preferable to heat at least a region to be pressed, to a uniform temperature before applying pressure.

According to the present invention, the moisture added in the moisture controlling step covers up the entire cloth in the form of steam, and therefore the cloth can be heated uniformly. Further, when temperature of the cloth increases, the moisture serves as a lubricant, enabling efficient release of the internal stress of the cloth.

The reason why the dimensional stability of the cloth can be obtained by performing the thermal pressing is not clearly known yet. However, it is presumed that a structure of the cloth under the heated state is fixed by the pressure applied in the pressing operation. The stabilization prevents excessive shrinkage of the cloth, while increasing smoothness of cloth surfaces, making easy to handle the cloth in the processes to follow.

In order to obtain the above dimension stabilizing effect, it is important that each of the operations is made on a horizontal plane in which the cloth is not subjected to tension. According to the conventional sponging treatment apparatus, the cloth is wound around a cylindrical roller at least in one step of the treating process. Therefore, the treatment is made while the cloth is under tension caused by the roller or by the weight of the cloth itself. The tension leaves latent stress in the cloth, which is released at the time of thermal bonding process, often causing the dimensional change, wrinkles and so on According to the present invention, the entire process of the cloth stabilization treatment is performed while the cloth is supported horizontally, and therefore the cloth is supported horizontally, and therefore the cloth is not subject to tension or other force caused for example by the weight of the cloth itself. Further, no deformation is caused by curved surfaces of the rollers. Thus, the cloth can be sufficiently stabilized.

In order to stabilize the cloth more reliably, it is preferable to include a temperature-holding step of heating the cloth and maintaining a temperature of the cloth between an upper and a lower non-gas-permeable belts running horizontally, without causing tension, before the thermal pressing step. In the temperature-holding step, the water added in the moisture controlling step is first vaporized to cover up the entire cloth and then the temperature continues to increase. Further, by heating the cloth between the non-gas-permeable belts, the entire cloth can be heated more uniformly, with smaller amount of water added. Still further, the heating is made in a state in which the cloth is supported free of tension, allowing the cloth to freely shrink for example, enabling sufficient release of the internal stress of the cloth.

Further, even if heating means such as a heater has a fairly high surface temperature, non-uniform heating will not result, allowing the entire cloth to be heated to a predetermined temperature in a short time. A temperature in the temperature-holding step through the thermal pressing step is preferably 130° C.~180° C.

Dimensional change of the cloth is a problem when the interlining cloth is bonded. Temperature for this operation is determined from a melting temperature of the binder which is made from a thermally plastic resin, and is about 130° C. in general. If the heating temperature is not greater than a thermal-bonding temperature, the cloth is often stretched and/or shrunken at a temperature used in the interlining-cloth bonding process. Therefore, the heating temperature should be higher than the thermal-bonding temperature, or at least not lower than 130° C. Further, preferably, the heating should be performed at a temperature at least 10 degrees higher than the thermal-bonding temperature. By treating at the temperature higher than the temperature used in the thermal bonding, the dimensional stability in the thermal bonding process can be more stable and reliable. Still further, the temperature should be higher by more than 15° C. if the cloth has appropriate heat resistance.

On the other hand, the temperature not lower than 180° C. is not preferred because texture of the cloth is lost although the stabilization of the cloth is achieved.

Further, a temperature of 150° C.~170° C. can also be used in the finish-pressing process. Therefore, in order to stabilize the cloth in the finish-pressing process, the heating temperature should preferably be higher than the finish-pressing temperature.

Preferably, a pressure for the thermal pressing step is 0.02 $kg/cm^2$~3 $kg/cm^2$. The pressure may be changed depending on the kind, thickness and so on of the cloth, but should be selected in a range in which wrinkles formed in previous steps can be removed, texture of the cloth is not be deteriorated, and desired thermal treatment effect can be rendered. If the pressure is smaller than 0.02 $kg/cm^2$, the wrinkles in the cloth may not be removed. On the other hand, if the pressure is greater than 3 $kg/cm^2$, the cloth may be flattened and texture of the cloth may be deteriorated. In order to reliably stabilize the cloth as well as to smoothly remove the wrinkles etc., the pressure may be gradually increased in the thermal pressing step.

In the temperature-holding step through the thermal pressing step, the weight of the cloth is preferably reduced to 98~90% of the normal weight of the cloth. In the interlining-cloth bonding process or the finish-presing process, the weight of the cloth is significantly reduced from the normal weight since the cloth is subjected to a high temperature. The above rate of weight reduction was selected with respect to a corresponding weight reduction rate in the interlining-cloth bonding process through the finish-presing process. The reason why the cloth can be stabilized if heated until its normal weight is lost is not clearly known yet. However, it is presumed that the thermal treatment effect is so reliably retained that a similarly high temperature applied thereafter will not easily cause dimensional change etc.

If the temperature and the time for the heating is selected within the range given above, not only is the dimensional stabilization effect of the cloth obtained but also the cloth is protected from excessive loss of the water contained therein. Therefore, it becomes possible to stabilize the cloth without deteriorating the texture of the cloth or deteriorating mechanical characteristics of the cloth.

The time for heating in the temperature-holding step through the thermal pressing step is preferably selected from 5 seconds through 120 seconds. In many kinds of the cloth, the moisture contained therein can be reduced to the value given above within 5 seconds~120 seconds if the cloth is heated at a temperature for bonding the interlining-cloth or at a temperature higher by 10° C. Therefore, by controlling the heating time within the above range, moisture contents in the temperature-holding step through the thermal pressing step can be controlled accurately. Further, most kinds of the cloth can be successfully treated in the above range. Since moisture is added in the moisture controlling step, uniform temperature is maintained even if the heating time becomes slightly long, allowing the entire cloth to be heated to a uniform temperature. It should be noted here that this heating time, too, should preferably be longer than the heating time used in bonding the interlining cloth.

A forced cooling step may be performed after the thermal pressing step. By performing the forced cooling step, the effect in the thermal pressing step can be assured more reliably. In the above forced cooling step, it is preferable again, that the cooling is performed while the cloth is supported on a belt running horizontally, so as to avoid a situation in which the cloth is cooled under stress for example. The forced cooling step can be achieved by passing room-temperature air or cooled air through the cloth.

In the stabilizing method according to the present invention, characteristics of the cloth are not significantly deteriorated since the moisture content of the cloth is controlled before the heating operation is performed. Further, since the moisture is added before the heating operation, the entire cloth can be heated uniformly by utilizing the high-temperature steam generated. Therefore, it becomes possible to perform accurate heating operation, making the method applicable even to a cloth weak in heat resistance.

An apparatus for stabilizing a cloth for achieving the above method for stabilizing a cloth comprises transporting means for transporting the cloth while supporting the cloth on a belt running horizontally, moisture controlling means for adding water to the cloth being transported by the transporting means, and thermal pressing means for thermally pressing the cloth being transported by the transporting means.

The transporting means is provided for transporting the cloth while performing treatment at each of the means, and includes a belt which runs horizontally, so as not to cause tension to the cloth.

The moisture controlling means can be a steam spraying device or a water spraying device for example. The steam spraying device can be constituted easily by using a steam generator such as a boiler. Further, combination with the conventional sponging treatment apparatus may be made. In such a case, the moisture controlling means should be capable of drying or moistening the cloth to a predetermined moisture content at a last stage of the sponging treatment apparatus.

The thermal pressing means applies pressure to the cloth under heat, and is constituted so as to apply pressure while the cloth is at a predetermined temperature. The thermal pressing means can be a heatable pressing roller in which the roller itself is heated. Alternatively, combination of a heater to heat the cloth and a roller to press the cloth may be used as the thermal pressing means.

Separate from the thermal pressing means, a temperature-holding means for heating the cloth to and maintaining the temperature of the cloth at a predetermined level may be provided, so that the cloth can be sufficiently heated before performing the pressing operation.

It is desirable to provide a forced cooling means for forcibly cooling the cloth after the thermal pressing step. A constitution for this can be to pass room-temperature air or cooled air through the cloth, thereby forcibly cooling the cloth.

As a configuration of the cloth stabilizing apparatus, there may be a moisture controlling region provided with the moisture controlling means, a temperature-holding region in which the heating means heats and maintains the cloth at a temperature, a thermal pressing operation region in which the pressing operation is performed by the pressing means to the cloth heated and maintained at the temperature, and a forced cooling region in which the cooling means forcibly cools the cloth; and the transporting means transports the cloth sequentially to each of the regions.

The stabilizing apparatus is provided with regions in which one of the steps according to the present invention is performed, and the cloth is transported between these regions by the transporting means.

It is desirable that the transporting means supports and transports the cloth on a belt so as not to cause tension to the cloth.

Further, the transporting means may not be a single device, but may be combination of a plurality of belt mechanisms.

As the transporting means in the temperature-holding region through the thermal pressing operation region, a set of transporting belts sandwiching the cloth from above and below, and made of material not permeable by steam can be used. The sandwiching belt, working with the heating means and the pressing means, can maintain the cloth at a predetermined temperature and a predetermined pressure. The sandwiching belts transport the cloth by sandwiching the cloth from above and below in the temperature-holding region, promoting the release of the residual strain of the cloth without applying extra force to the cloth, and to increase the dimensional stability.

In order to make use of the steam generated from the cloth for steaming operation thereby heating the entire cloth uniformly, it is desirable that the sandwiching belts be made of material not permeable by steam. Although a certain amount of the steam will transpire from both sides of the sandwiching belts, the amount of transpiration can be limited, and therefore it is possible to heat and maintain the temperature under a uniform condition without rapidly decreasing the water content of the cloth. Further, since the cloth is transported generally in a flat plane, being supported by the upper and lower sandwiching belts, there is no possibility for the cloth to develop flaw such as bend.

The heating means is not limited by the electric heater, but may be an electromagnetic heating device for example.

As the thermal pressing means, a set of pressing rollers sandwiching the sandwiching belts may be used. The pressing rollers apply pressure to the cloth via the sandwiching belts, making certain the stabilization of the cloth. Further, it is possible to remove wrinkles etc., as well as to smoothen the surfaces of the cloth. There is no special limitation to a construction etc. of the pressing rollers as long as the rollers are capable of performing the pressing operation at the maintained temperature. There is no specific limitation either to the number of rollers, and a plurality of pressing rollers disposed continuously along the sandwiching belts may be provided.

As the thermal pressing means, a pair of upper and lower pressing plates sandwiching the sandwiching belts for applying pressure via the sandwiching belts can be used. By using the pressing plates, it becomes possible to press the cloth uniformly over a wide area. This makes possible to reliably obtain the thermal treatment effect without deteriorating the texture of the cloth.

Further, the pressing means may be constituted so as to continuously increase the pressure in a transporting direction of the cloth. By continuously increasing the pressure, the pressing operation can be performed without applying excessive force to the cloth or without causing unnecessary deformation in the cloth. Further, even if the cloth is transported at a high speed, the pressure can be applied stably.

Further, in the moisture controlling step, the cloth stretches and/or shrinks when added with water. This stretching and/or shrinking can develop stress between the cloth and the supporting belt etc., or develop a wrinkle in the cloth. In order to prevent this, a stretch-and-shrinkage controlling step is preferably performed after the moisture controlling step. Generally, the stretching-and-shrinking control step stretches the cloth widthwise for removal of the wrinkle etc.

Inventions according to claim 25 through claim 31 of the present application are applications of the cloth stabilizing method according to the present invention to a method for manufacturing a cloth.

Conventionally, manufacture of cloth and stabilizing treatment of the cloth are performed independently. This increases not only the number of steps but also operating cost.

The method for stabilizing a cloth according to the present invention can be applied to a wide variety of cloths, not only to a cloth to which an interlining cloth is to be thermally bonded, but also to a variety of cloths which needs dimensional stability. Further, the significant dimensional stabilization makes the cloth to be applicable to a variety of after treatments. Therefore, by including the present invention as part of manufacturing steps of the cloth, it becomes possible to manufacture and stabilize the cloth simultaneously.

BEST MODE FOR CARRYING OUT THE INVENTION

Hereinafter, embodiments of the present invention will be described specifically, with reference to the drawings.

Figure 1:
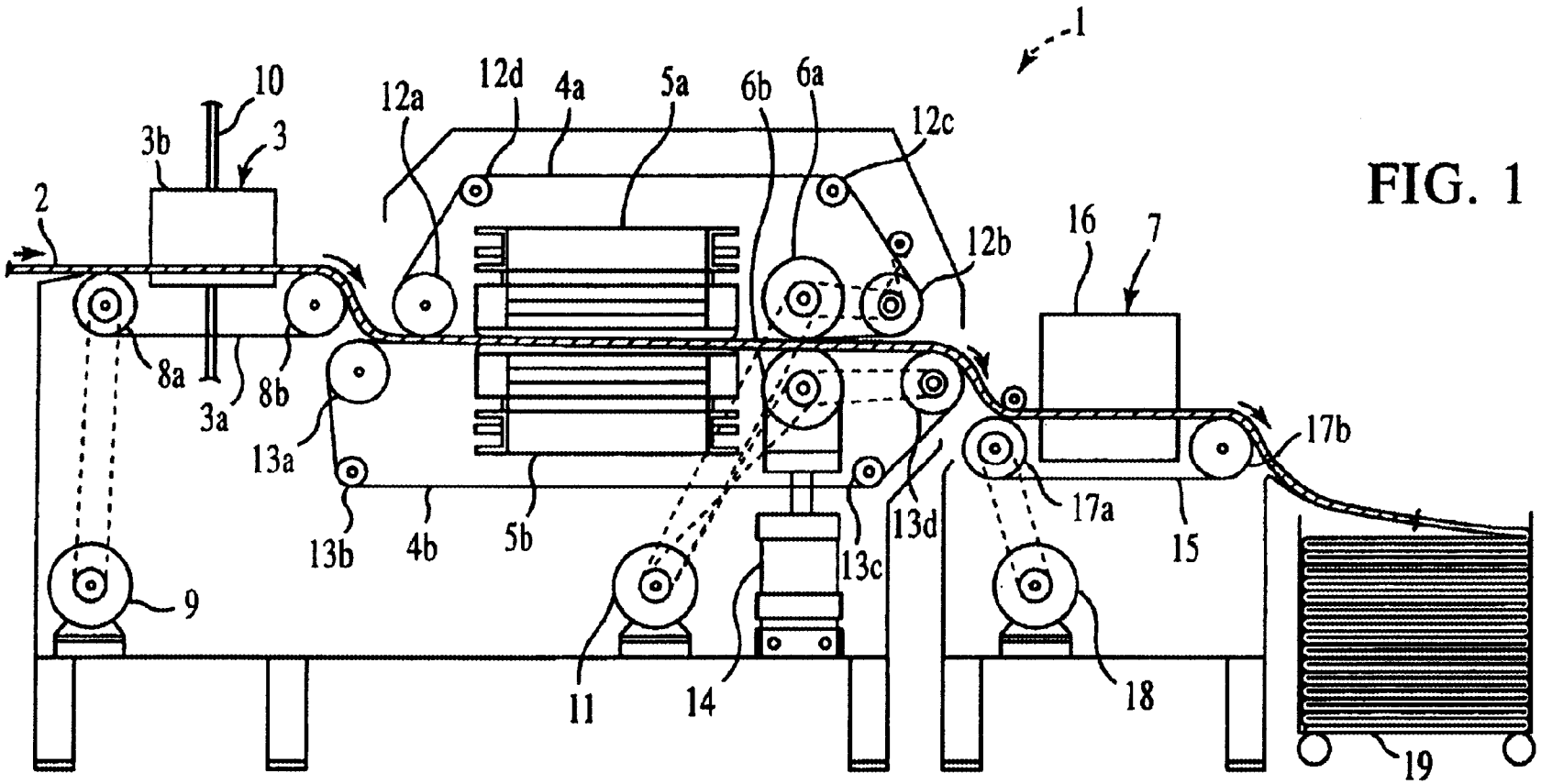
FIG. 1 is a schematic diagram showing a stabilizing apparatus according to the present invention.

FIG. 1 shows a first embodiment of the present invention. An apparatus 1 for stabilizing a cloth, shown in FIG. 1 comprises a moisture controlling device 3 for controlling moisture in a cloth 2, a pair of sandwiching belts 4*a*, 4*b* for transporting the cloth 2 by sandwiching from above and below, heaters 5*a*, 5*b* for heating, from above and below, the cloth 2 in transportation between the sandwiching belts 4*a*, 4*b*, a pair of pressing rollers 6*a*, 6*b* for pressing the heated cloth 2, and a cooling device 7 for forcibly cooling the cloth.

The moisture controlling device 3 includes a conveyer belt 3*a* onto which the cloth is placed for transportation, and a spraying device 3*b* for spraying the cloth 2 held by the conveyer belt 3*a* with steam generated by an unillustrated boiler. The conveyer belt 3*a* is wound around pulleys 8*a*, 8*b* and is driven by an electric motor 9. The conveyer belt 3*a* is made of a gas permeable material.

The spraying device 3*b* introduces the steam from a pipe 10 connected to the boiler, controls the steam to a predetermined moistening level, and sprays to the cloth 2 from above. Excess steam which passes through the cloth is discharged downwardly. By spraying the cloth 2 with the steam, the cloth 2 is added with moisture, and water content in the cloth is adjusted.

The sandwiching belts 4*a*, 4*b*, and the pressing rollers 6*a*, 6*b* are driven by an electric motor 11 and belt transmission means. The sandwiching belts 4*a*, 4*b* are made of a non-gas-permeable heat-resistant material. Further, the sandwiching belts are adjusted so as not to apply pressure to the sandwiched cloth being held and transported.

Each of the sandwiching belts 4*a*, 4*b* has a surface treated with Teflon, being heat resistant as well as capable of reducing friction with the cloth. Therefore, the cloth does not receive excessive force during the transportation. The sandwiching belts 4*a*, 4*b* are supported by a plurality of rollers 12*a*~12*d*, and 13*a*~13*d* respectively, so as to provide inside spaces. Each of the inside spaces is disposed with one of the heaters 5*a*, 5*b* and pressing rollers 6*a*, 6*b*.

Each of the heaters 5*a*, 5*b* contacts corresponding one of the sandwiching belts 4*a*, 4*b*, from inside, longitudinally with respect to a direction of transporting the cloth, in a predetermined length, so as to heat the cloth 2 from above and below via the sandwiching belts 4*a*, 4*b* while maintaining the cloth at a predetermined temperature for a predetermined amount of time. There is no specific limitation to a heating element used in the heaters 5*a*, 5*b*. Thus, the heating element may be of an electric resistance type, an electromagnetic induction type, and so on.

The pressing rollers 6*a*, 6*b* apply pressure to the cloth 2 via the sandwiching belts 4*a*, 4*b*. The lower pressing roller 6*b* is vertically movable, and can apply a desired amount of pressure against the upper roller 6*a* through control by a pressure controlling device 14.

The cooling device 7 includes a conveyer belt 15 on which the cloth 2 coming out of the sandwiching belts 4*a*, 4*b* is placed and transported, and a blowing device 16 for passing room-temperature air or cooled air through the cloth 2 held by the conveyer belt 15. The blowing device 16 has an upper inside portion provided with a blower, and a lower inside portion provided with a suction device. The conveyer belt 15 is made of a gas permeable material. By passing the air through the cloth being transported, the heat applied in the previous step can be removed. It should be noted here that the blowing device 16 may be provided with a cooling device for cooling the air so that the cooled air is passed through the cloth 2. The conveyer belt 15 is wound around pulleys 17*a*, 17*b* and driven by an electric motor 18 so as to transport the cloth 2 on the belt within the blowing device 16.

The cloth coming out of the cooling device 7 is folded into a bucket 19 for a next process.

Figure 2:
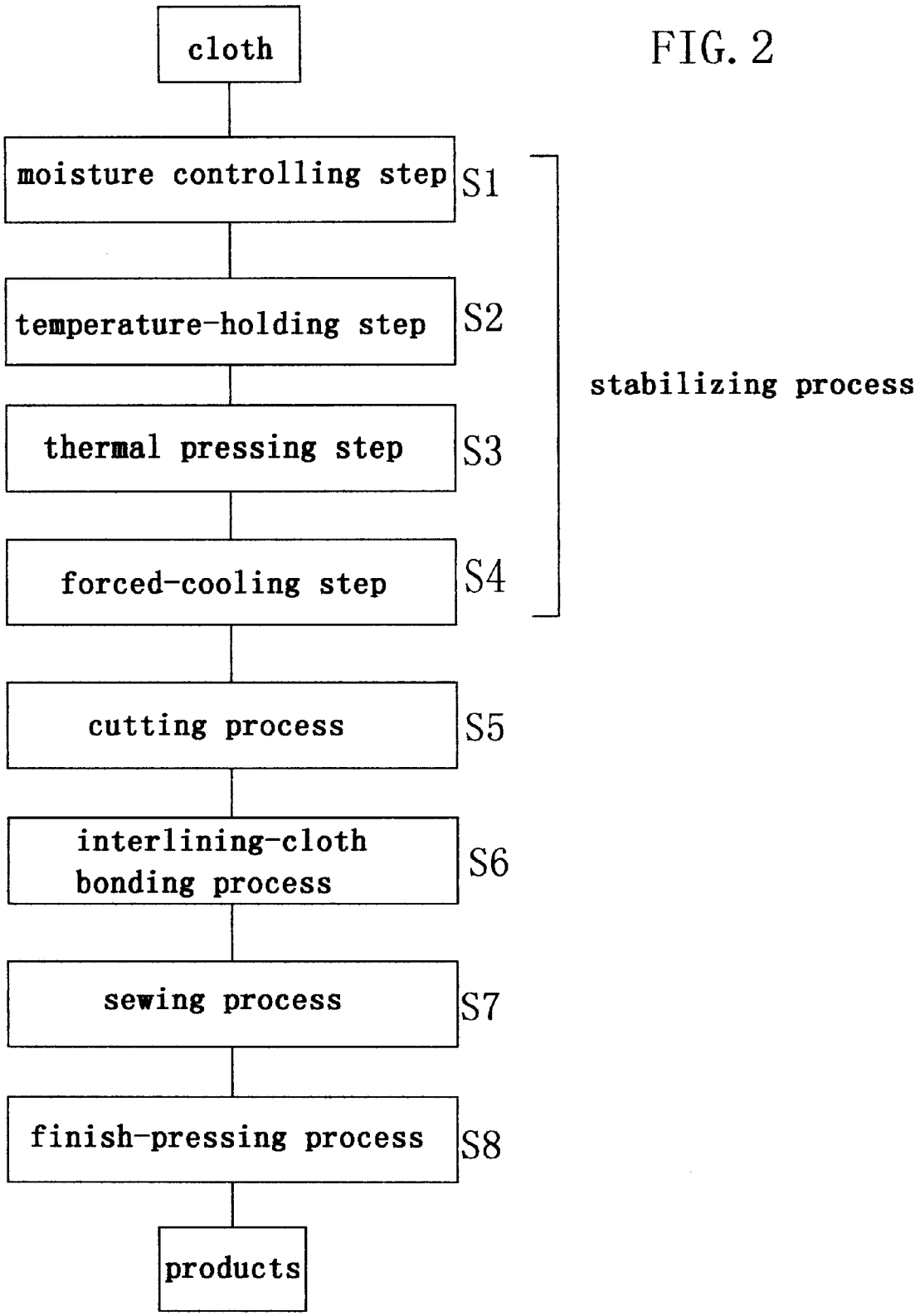
FIG. 2 is a flowchart showing an outline of product manufacturing processes including a stabilizing process according to the present invention.

FIG. 2 is a flowchart showing an outline of a cloth stabilizing process (S1~S4) and processes (S5~S9) in which a sewn product is completed according to the present embodiment.

According to the present embodiment, the product is completed through; the cloth stabilizing process (S1~S4) performed by the stabilizing apparatus 1 shown in FIG. 1, a cutting process (S5) in which the cloth and an interlining cloth are cut into predetermined sizes, an interlining-cloth bonding process (S6) in which the cloth is laminated with and thermally bonded with the interlining cloth, a sewing process (S7) in which the cloth laminated with the interlining cloth is sewn, and a finish-pressing process (S8) in which the sewn cloth bonded with the interlining cloth is thermally pressed.

The cutting process (S5) through the finish-pressing process (S8) is performed as conventionally, and therefore will not be described herein. Description will be made for the stabilizing process (S1~S4) according to the present invention. It should be noted here that the cutting process (S5) through the finish-pressing process (S8) mentioned as above name only major processes involved in a whole sewing stage, and thus are not limited by the names of the processes.

According to the present embodiment, as shown in FIG. 1, the heaters 5*a*, 5*b* and the pressing rollers 6*a*, 6*b* are provided in separation. While the cloth is transported between the heaters 5*a*, 5*b*, a temperature-holding step S2 is performed. Then, while a temperature at the temperature-holding step S2 is maintained, a pressing operation is performed. It should be noted here that the temperature-holding step may be eliminated by making the pressing rollers heatable or by integrating the heaters with the pressing rollers.

Figure 3:
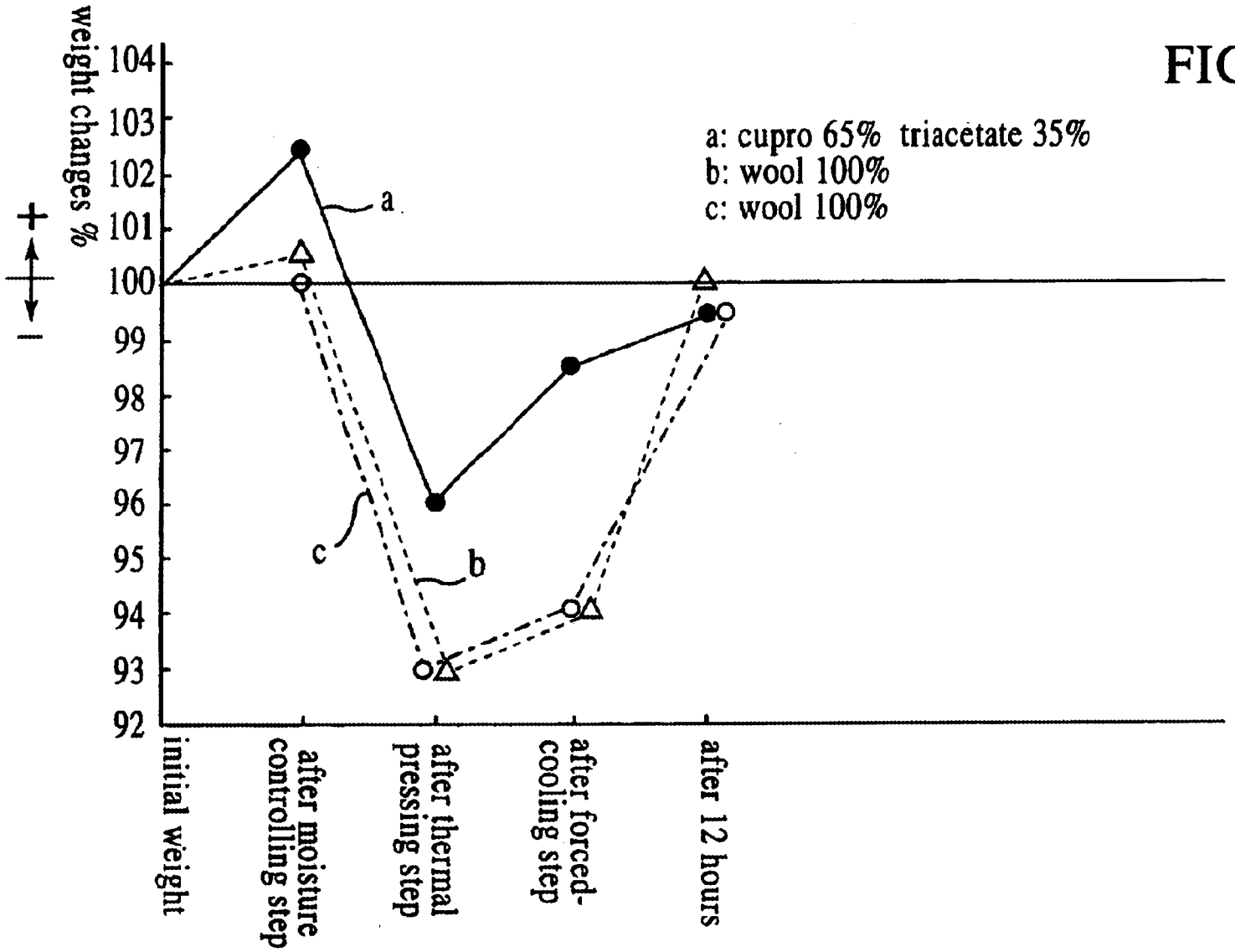
FIG. 3 is a graph showing weight changes of a cloth during the stabilizing process according to the present invention.

FIG. 3 shows weight change of the cloth during the stabilizing process (S1~S4) according to the present embodiment. The stabilizing process according to the present embodiment is performed in an environment with a room temperature of 25° C., and a relative humidity of 60%. An initial norm weight of the cloth is a natural weight in the above environment. With the arrangement according to the present embodiment, three kinds of cloths underwent the stabilizing process according to the present invention, the interlining-cloth bonding process, and the finish-pressing process, for comparison in terms of dimensional change with those treated in the conventional sponging treatment.

The moisture controlling step S1 is performed by the moisture controlling device 3 shown in FIG. 1. By passing the steam through the cloth 2 in the moisture controlling device 3, an amount of water not greater than 5% of the cloth weight (the initial weight) is added. It should be noted here however, that a certain kind of cloth contains an excess amount of water. In such a case, the weight may not increase, as exemplified by material c in FIG. 3, even if the steam is passed. Further, if the cloth contains excess amount of water, the amount of water may be adjusted by using dry air for example, in the moisture controlling step.

The above amount of water content decreases friction and increases lubrication between fibers or yarns within the cloth, promoting release of stress, while protecting the cloth from being deteriorated in its texture and mechanical characteristics by an intense thermal load applied in the temperature-holding step and a thermal pressing step to be described next.

If no water is added, the temperature-holding operation is performed while the fibers or yarns have a high friction coefficient, making impossible to stabilize the cloth, and the cloth may possibly be damaged. On the other hand, if the amount of water to be contained is too much, a long time is necessary to heat the cloth to a predetermined temperature. Preferably, 2% through 4% of water should be added though the rate varies depending on the kind of cloth.

After the moisture controlling step (S1), the cloth undergoes the temperature-holding step (S2) performed by the sandwiching belts 4*a*, 4*b* and the heaters 5*a*, 5*b*.

In the temperature-holding step, the cloth sandwiched between the sandwiching belts 4*a*, 4*b* is heated to and held at 150° C. for about 15 seconds while being transported. The above temperature-holding time can be controlled by controlling a driving speed of the sandwiching belts 4*a*, 4*b*. Since the sandwiching belts 4*a*, 4*b* are made of non-gas-permeable material, the cloth as a whole can be heated and held at a uniform temperature via steam released from the cloth. More specifically, the cloth is heated through steaming by the high temperature vapor. Although the steam released from the cloth transpires from both sides of the sandwiching belts, an amount of transpiration is limited, and therefore there is a constant temperature and humidity condition created between the sandwiching belts, allowing the cloth to be heated under a uniform condition.

Next, the thermal pressing step (S3) is performed while the cloth is held between the sandwiching belts 4*a*, 4*b* under the temperature-holding state. According to the present embodiment, the pressing is made at a same pressure as in the interlining cloth bonding process (S6), i.e. at 1 kg/cm$^2$. By performing the thermal pressing step (S3), fabric structure under the heated state can be fixed, and it becomes possible to stabilize the cloth while preventing the cloth from excessive shrinkage. Further, wrinkles, crimps and so on developed in the cloth 2 in the moisture controlling step (S1) and the temperature-holding step (S2) can be removed and the surfaces of the cloth can be smoothened.

As shown in FIG. 3, weight of the cloth after the thermal pressing step (S3) is reduced to 98%~90% of the room-temperature cloth weight (the initial weight). By controlling the temperature of the heaters 5*a*, 5*b* and running speed of the sandwiching belts 4*a*, 4*b*, the above weight reduction rate can be controlled easily.

After the thermal pressing step (S3) is finished, a forced cooling step (S4) is performed by the cooling device 7, in which the cloth 2 is cooled to the room temperature, upon which the stabilizing process is completed. As shown in FIG. 3, the cloth absorbs moisture in the air after completion of the forced cooling step (S4), and the weight returns to the room-temperature cloth weight (the initial weight) in 12 hours.

Figure 4:
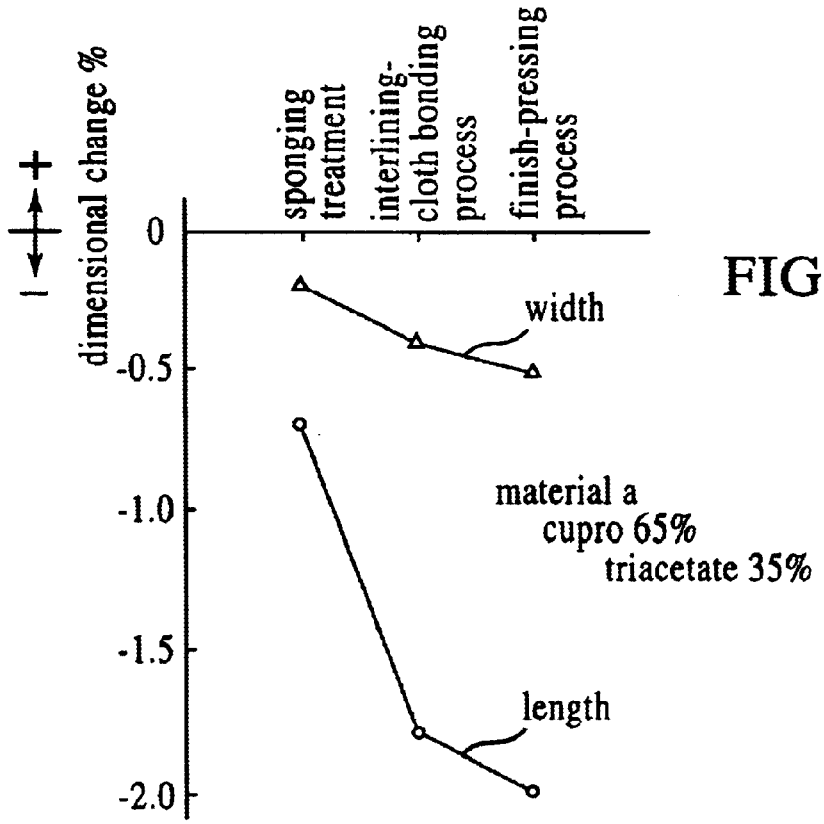
FIG. 4 is a graph showing weight changes of a cloth treated by a conventional sponging treatment followed by an interlining-cloth bonding process and a finish-pressing process.
Figure 5:
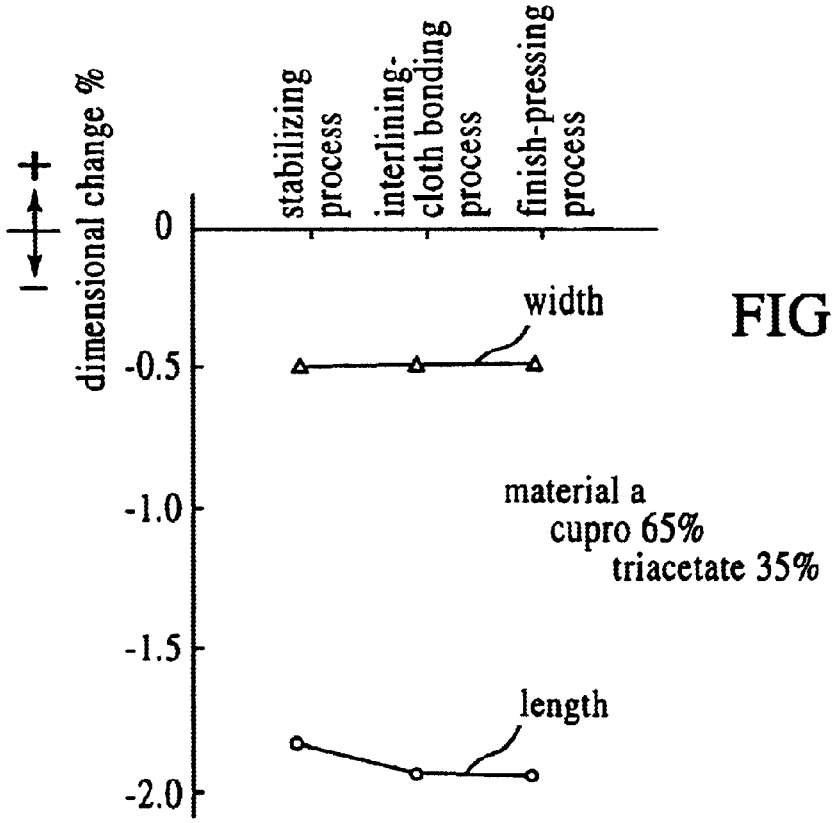
FIG. 5 is a graph showing weight changes of a cloth treated by the stabilizing process according to the present invention, followed by the interlining-cloth bonding process and the finish-pressing process.
Figure 6:
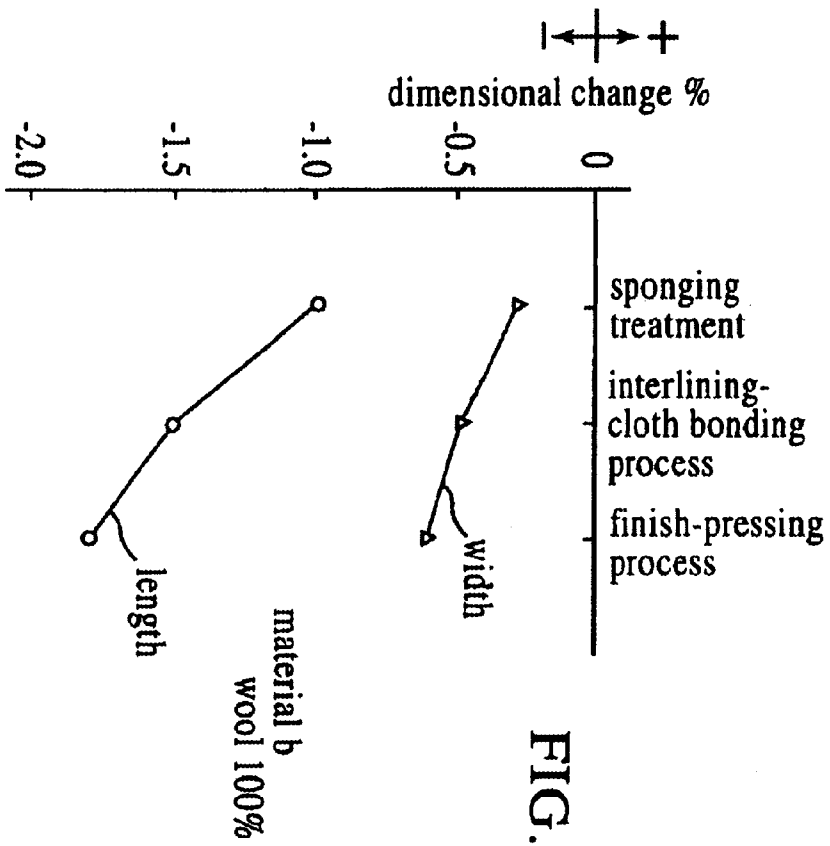
FIG. 6 is a graph showing weight changes of a cloth treated by the conventional sponging treatment followed by the interlining-cloth bonding process and the finish-pressing process.
Figure 7:
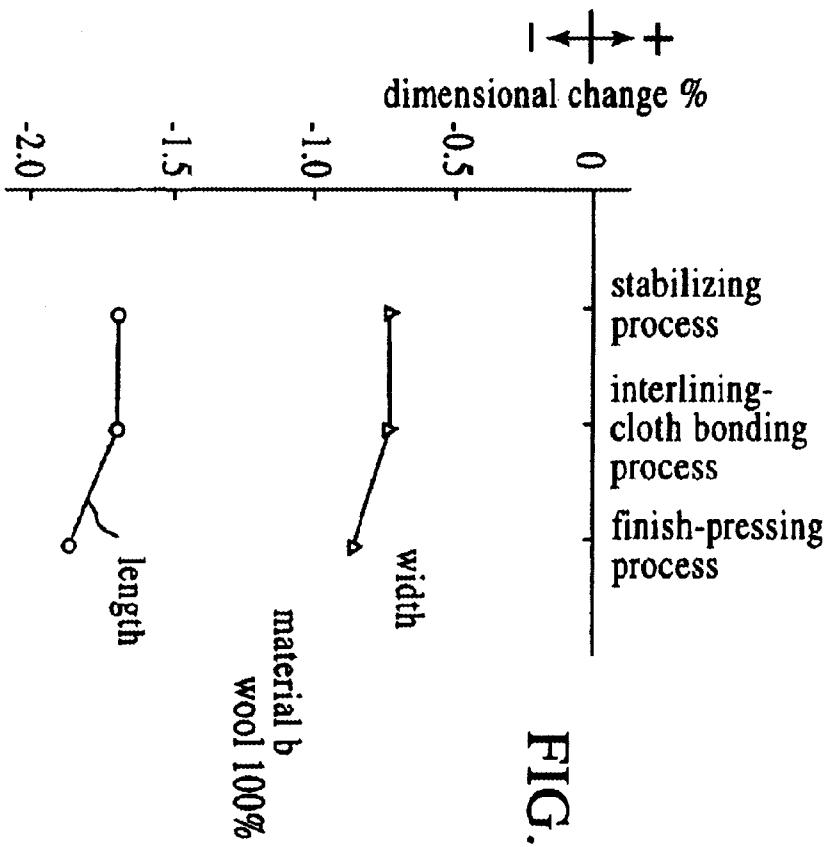
FIG. 7 is a graph showing weight changes of a cloth treated by the stabilizing process according to the present invention, followed by the interlining-cloth bonding process and the finish-pressing process.
Figure 8:
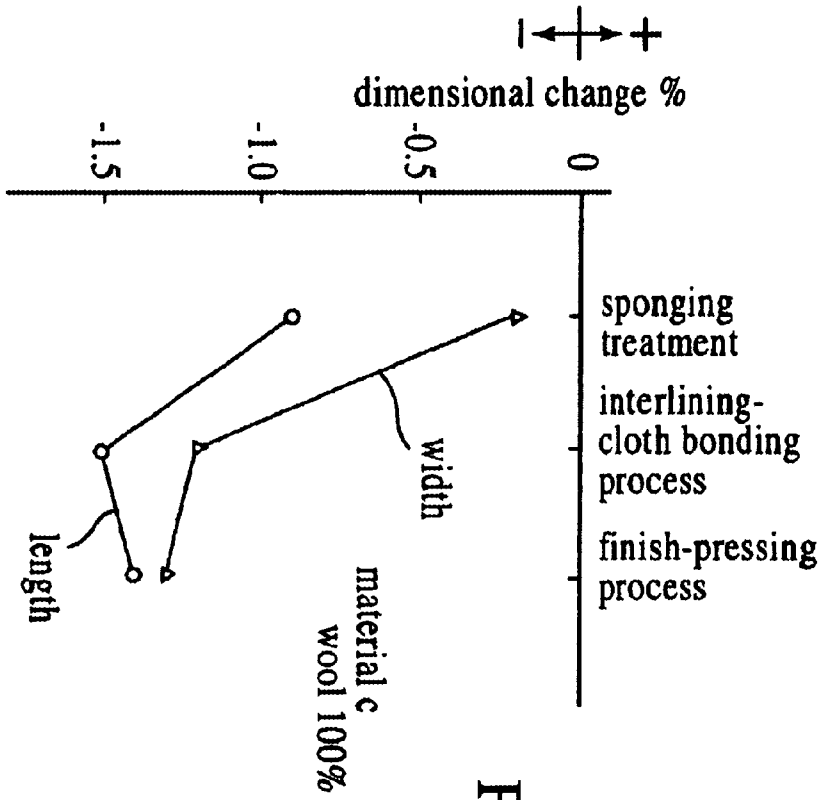
FIG. 8 is a graph showing weight changes of a cloth treated by the conventional sponging treatment followed by the interlining-cloth bonding process and the finish-pressing process.
Figure 9:
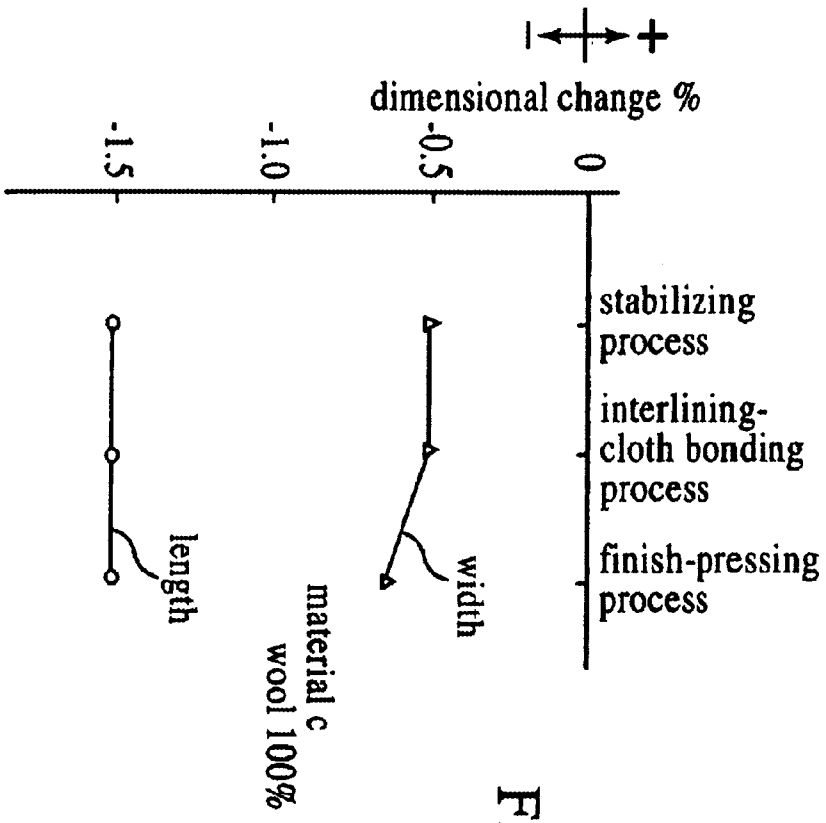
FIG. 9 is a graph showing weight changes of a cloth treated by the stabilizing process according to the present invention, followed by the interlining-cloth bonding process and the finish-pressing process.

FIG. 4 through FIG. 9 show dimensional change in the cloth. FIG. 4, FIG. 6 and FIG. 8 respectively show cases in which the cloth treated in the conventional sponging treatment underwent the interlining-cloth bonding process and the finish-pressing process. FIG. 5, FIG. 7 and FIG. 9 respectively show cases in which the cloth treated in the stabilizing process according to the present embodiment underwent the interlining cloth bonding process and the finish-pressing process. In each of the figures, lengthwise and widthwise dimensional changes of the cloth are shown in percentage (%) from initial dimensions.

It should be noted here that in each of the figures, the interlining-cloth bonding process was performed in the following manner. Specifically, a temperature of 130° C. was maintained for about 10 seconds, and then pressing was made at the pressure of 1 kg/cm$^2$. Further, the finish-pressing process was performed at a temperature of about 150° C. at a pressure of 0.4 kg/cm$^2$ for about 5 seconds. No water was added in either of the processes.

As shown in FIG. 4, FIG. 6 and FIG. 8, the cloth treated in the conventional sponging treatment, showed significant shrinkage in the interlining cloth bonding process and the finish-pressing process.

On the other hand, as shown in FIG. 5, FIG. 7 and FIG. 9, the shrinkage in the cloth is remarkably reduced by performing the stabilizing treatment according to the present invention.

By preventing the dimensional change of the cloth during the interlining-cloth bonding process, it becomes possible to perform precision cutting before the interlining cloth bonding process is performed, enabling remarkable reduction of the number of steps. Further, since the shrinkage in the finish-pressing process can be prevented, finish quality of the product can be remarkably improved, and rejection to the product due to a flaw such as wrinkles can be reduced.

Figure 10:
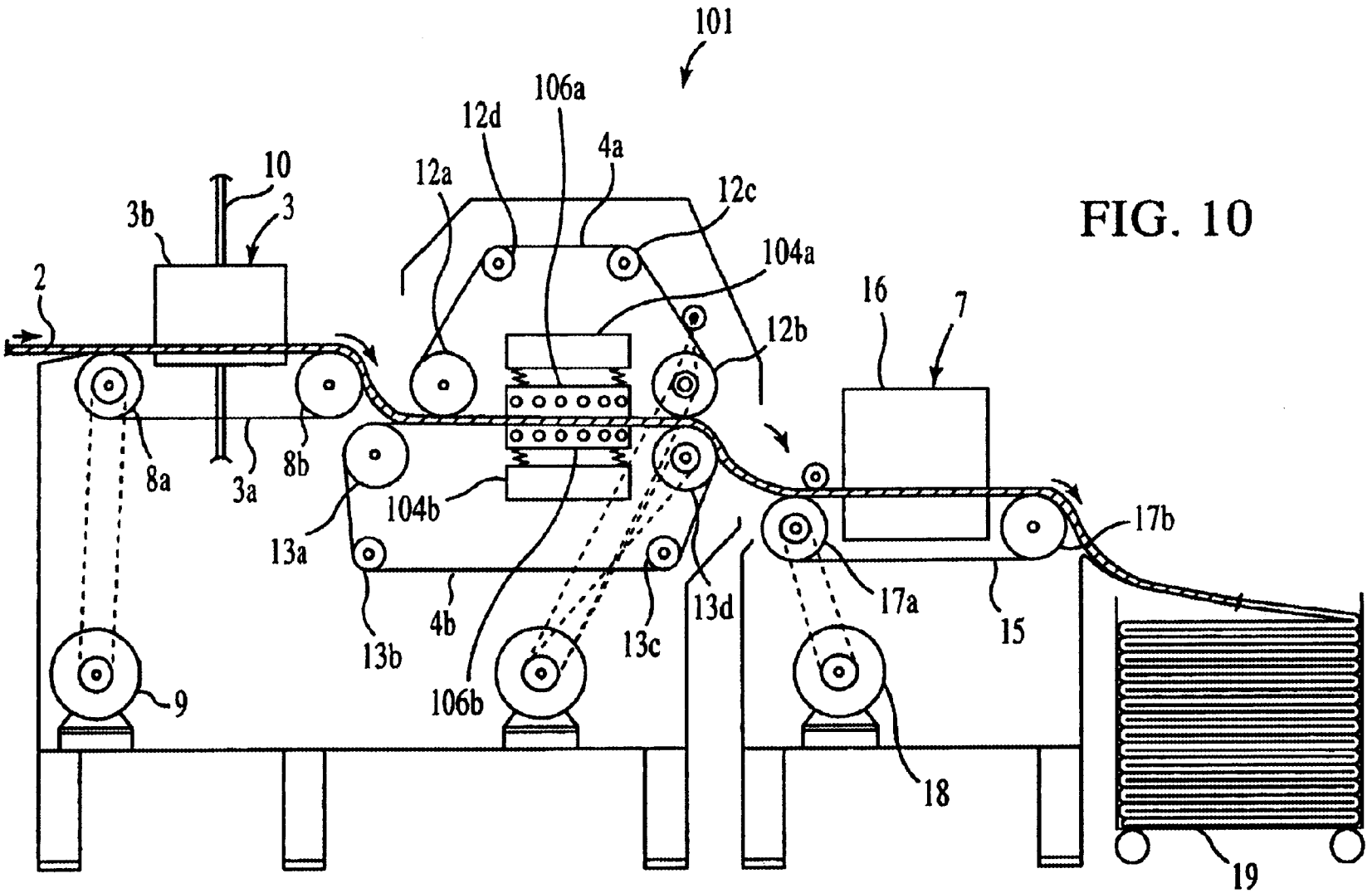
FIG. 10 is a diagram showing a second embodiment of the cloth stabilizing apparatus.

FIG. 10 shows a second embodiment of the cloth stabilizing apparatus. It should be noted that components and members identical with those in FIG. 1 are indicated by the same alpha-numeral codes. The stabilizing apparatus 101 shown in the present figure uses a pair of upper and lower pressing plates 106*a*, 106*b* as the thermal pressing means. The pressing plates 106*a*, 106*b* press the cloth 2 via the sandwiching belts 4*a*, 4*b*.

Figure 11:
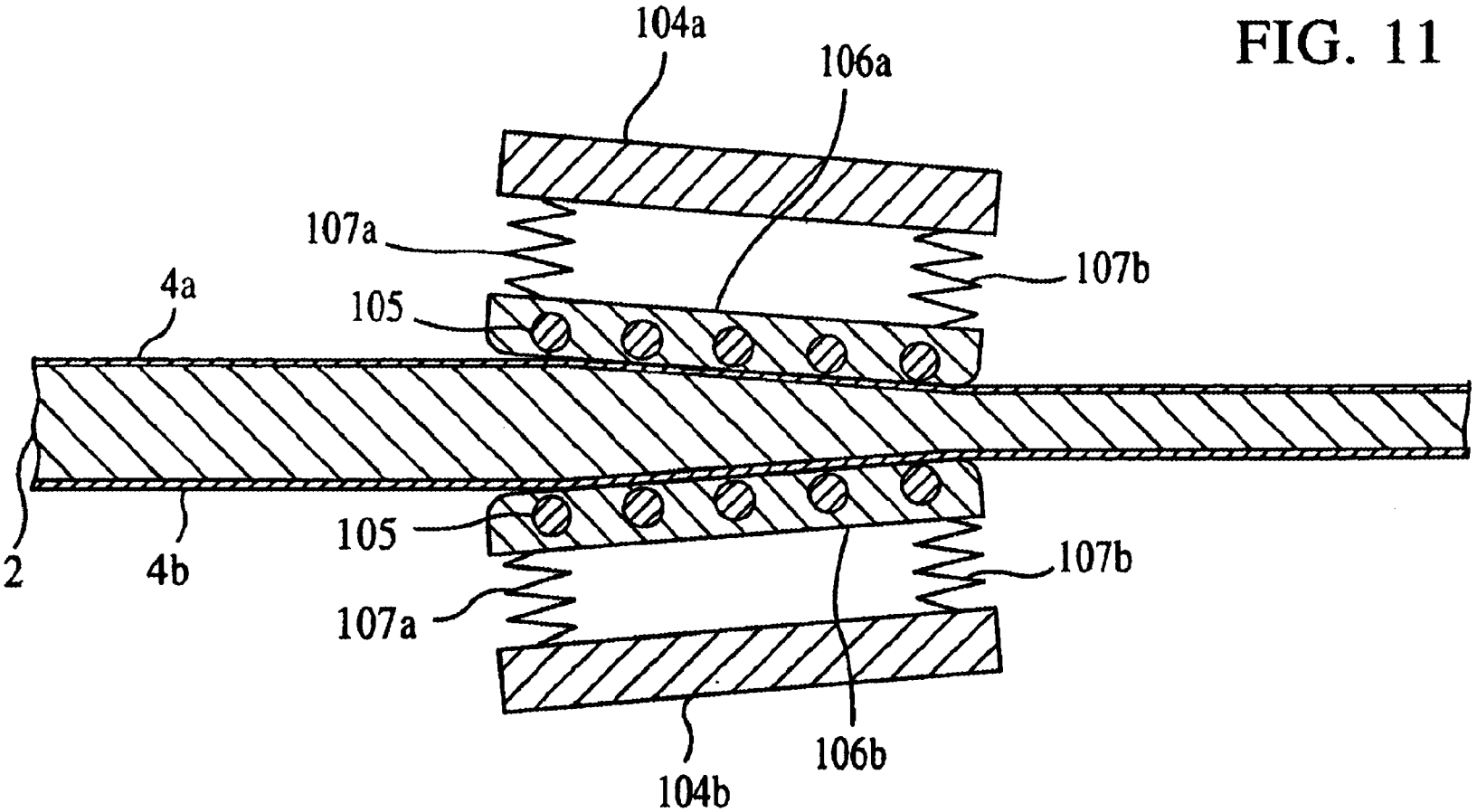
FIG. 11 is an enlarged view of a primary portion for description of a function of the stabilizing apparatus in FIG. 10.

FIG. 11 is an enlarged view of a primary portion for describing a function of the pressing plates 106*a*, 106*b* shown in FIG. 10. As shown in this particular figure, each of the pressing plates 106*a*, 106*b* is supported by a corresponding one of adjusting members 104*a*, 104*b* via springs 107*a*, 107*b* disposed in a fore-aft relationship. By controlling a facing angle made by the pair of adjusting members 104*a*, 104*b*, pressure is increased gradually in the direction of transportation of the sandwiching belts 4*a*, 4*b*. A heater 105 is provided in each of the pressing plate 106*a*, 106*b* so that the cloth 2 can be heated while the pressing force is being applied.

By using the pressing plates 106*a*, 106*b*, the pressing operation can be performed by gradually increasing the pressure. By gradually increasing the pressure, the pressing operation can be made without applying excessive force and without causing unnecessary deformation to the cloth. Further, a stable pressing force can be applied even if a transporting speed of the cloth is increased. Further, since the pressing plates 106*a*, 106*b* include the heaters 105, it becomes possible to perform the pressing operation and the heating operation generally simultaneously. Still further, since the cloth 2 can be heated to a predetermined temperature before a maximum pressing force is applied, there is no possibility for reduction in the effect of the thermal treatment.

Figure 12:
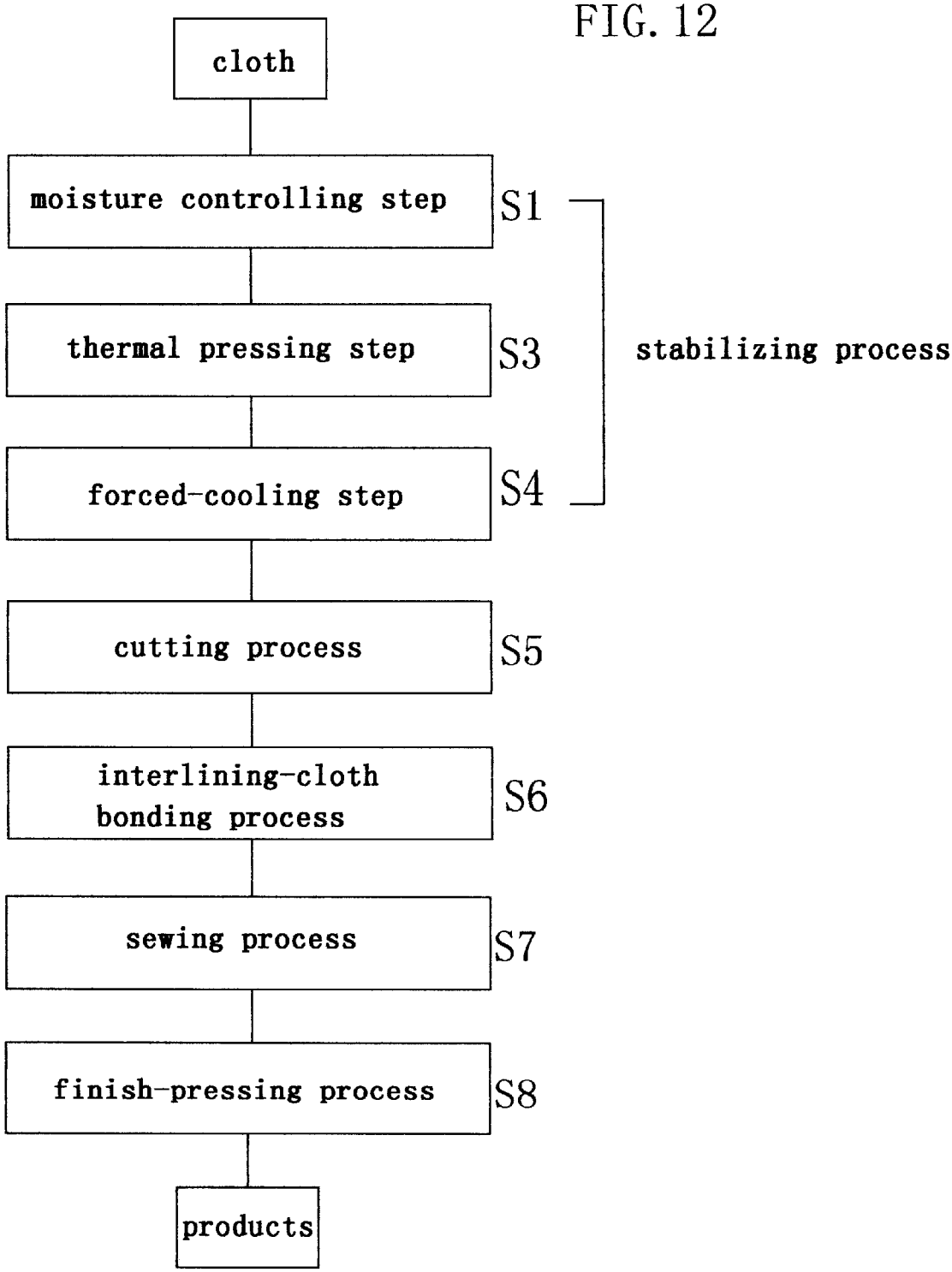
FIG. 12 is a flowchart showing an outline of product manufacturing processes when the stabilizing apparatus in FIG. 10 is used.

Still further, it becomes possible to eliminate the heaters 5*a*, 5*b* shown in FIG. 1, and as shown in FIG. 12, to eliminate the temperature-holding step. This makes possible to reduce a size of the apparatus.

Figure 13:
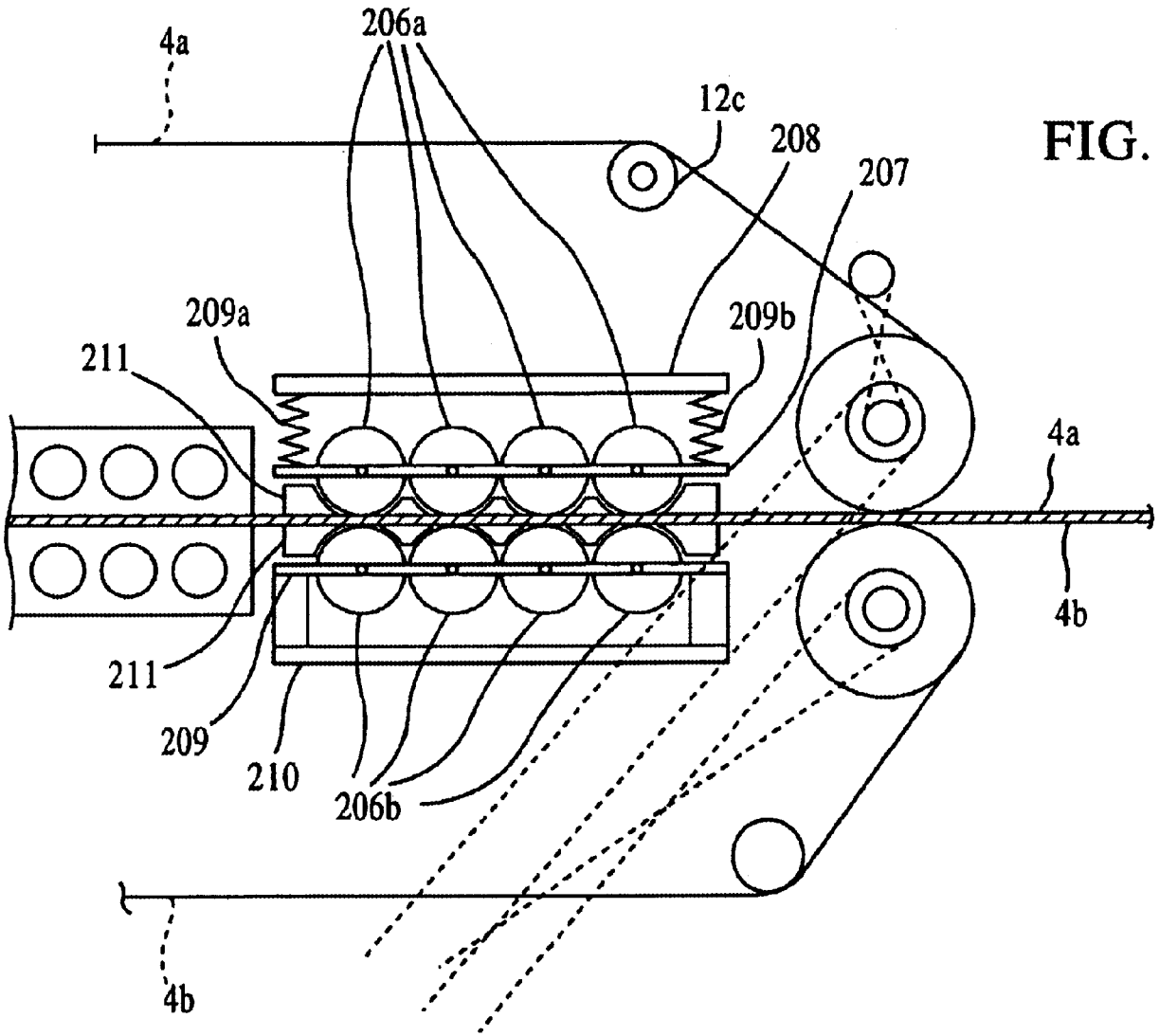
FIG. 13 is a diagram showing a third embodiment of the cloth stabilizing apparatus.

FIG. 13 shows a third embodiment of the stabilizing apparatus according to the present invention. According to this figure, four pairs of upper and lower pressing rollers 206*a*, 206*b* facing each other with the sandwiching belts in between are provided as the pressing means. It should be noted that FIG. 13 is an enlarged view of a primary portion, with the rest of arrangement being the same as shown in FIG. 1.

The pressing rollers 206*a* disposed above are rotatably supported by a connecting member 207. The connecting member 207 is supported by an adjusting member 208 via springs 209*a*, 209*b*. On the other hand, the pressing rollers 206*b* disposed below are rotatably supported by a connecting member 209, and then connected to a fixing member 210. The adjusting member 208 can be varied in its fixing angle so that pressure is increased gradually in the direction of transportation of the sandwiching belts 4*a*, 4*b*. A heater 211 is provided between each adjacent pair of the pressing rollers so that the cloth 2 can be heated while the pressing operation is performed.

Figure 14:
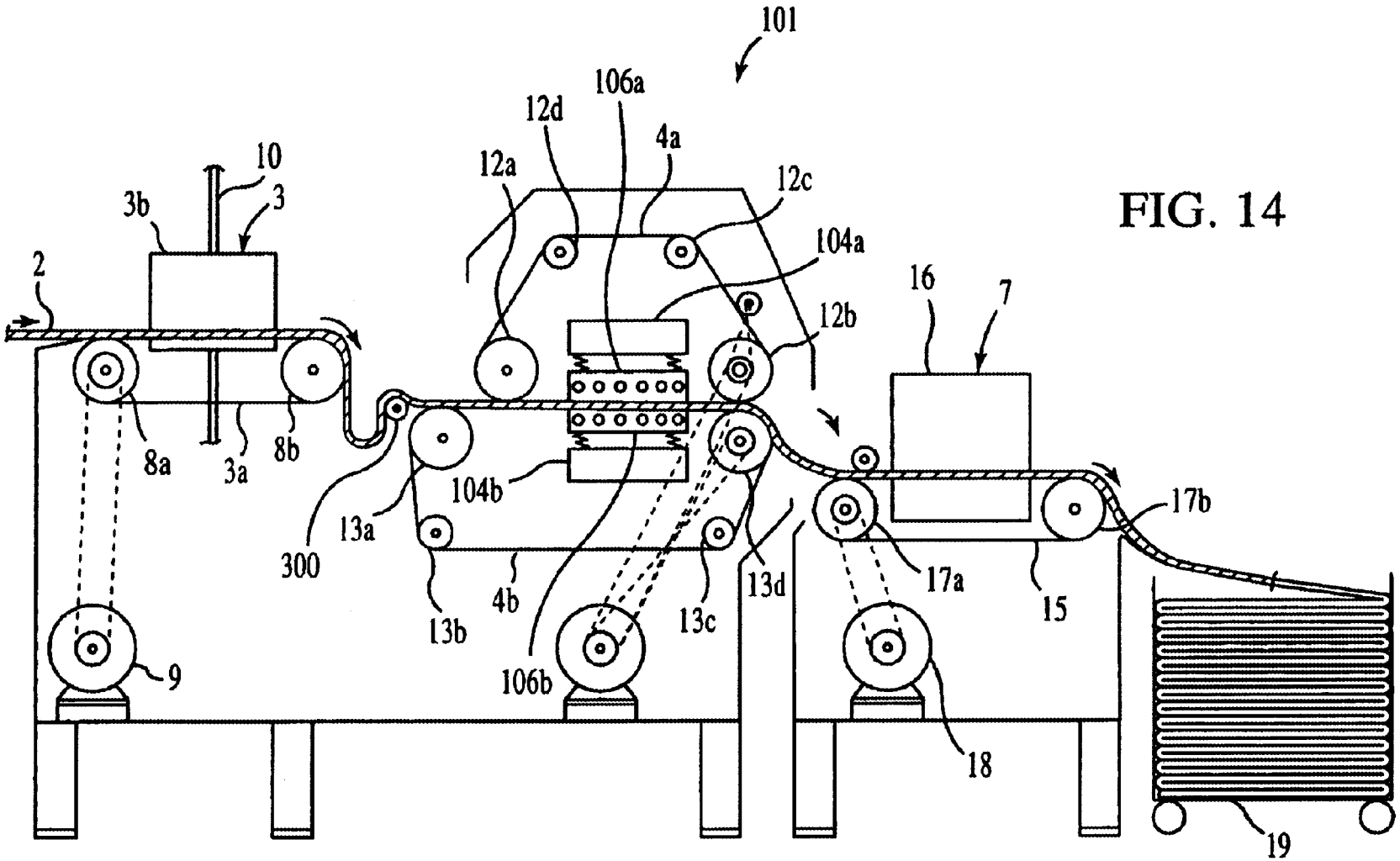
FIG. 14 is a diagram showing a fourth embodiment of the cloth stabilizing apparatus.
Figure 15:
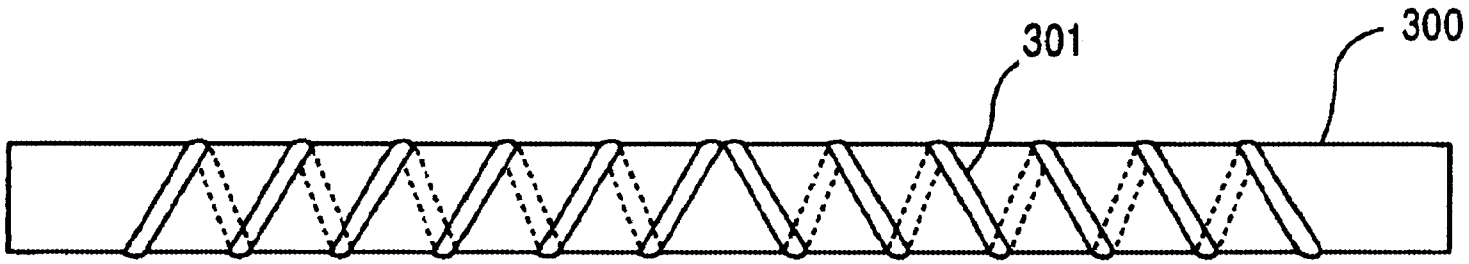
FIG. 15 is a side view showing a wrinkle removing bar used in the stabilizing apparatus in FIG. 14.

FIG. 14 and FIG. 15 show a fourth embodiment of the stabilizing apparatus according to the present invention. According to the stabilizing apparatus shown in this figure, a stretch and shrinkage controlling step is performed for controlling the stretch and shrinkage of the cloth, after the moisture controlling step.

When sprayed with steam and so on, the cloth stretches and/or shrinks to develop unnecessary stress or wrinkles. Because the cloth is usually very long, the wrinkles are apt to develop lengthwise. According to the present embodiment, the cloth is stretched widthwise after the moisture controlling step for elimination of the stress and wrinkles.

The stretch and shrinkage controlling step is performed by using a controlling bar indicated by numeral 300. As shown in FIG. 15, the controlling bar 300 has an outer circumferential portion formed with spiral ridges 301. The spiral ridges 301 start from a center portion and advance respectively toward a right end and a left end. The controlling bar 300 is disposed higher than a boundary surface of the sandwiching belts 4*a*, 4*b* so that the cloth is draped. The controlling bar 300 is rotated by weight of the cloth and pulling force of the sandwiching belts 4*a*, 4*b*. The cloth 2, guided by the spiral ridges 301, is stretched widthwise. This makes possible to remove stress and wrinkles resulted in the moisture controlling step, making sure that the dimensional stabilization in the thermal pressing step is uniform and reliable.

Scope of the present invention is not limited by the embodiments described above. For example, according to the embodiments, the cloth is sprayed with steam for the addition of water; however, the cloth may be sprayed with high temperature steam for the addition of water with simultaneous heating or pre-heating.

Further, according to the above embodiments, the stabilizing apparatus is a stand-alone type only for performing the cloth stabilizing method according to the present invention; however, the apparatus may be integrated with another cloth treating apparatus.

The temperature and pressure for bonding the interlining cloth, and the temperature and pressure for final pressing are not limited by those in the embodiments, and may be varied according to a characteristic and other conditions of the cloth to be treated.

Further, the cloth stabilizing apparatus according to the present invention can be integrated with an interlining-cloth bonding apparatus, into an apparatus capable of continuously manufacturing a laminated cloth.

Still further, a cloth already treated by the conventional sponging treatment and so on may be treated by the stabilizing method according to the present invention, for further improvement in dimensional stability. Combination with another chemical or mechanical cloth stabilizing method is also within the scope of the present invention.

What is claimed is:

1. A method for stabilizing a cloth comprising:

a moisture controlling step of adding water to the cloth;

a temperature-holding step of heating the cloth and maintaining a temperature of the cloth; and a thermal pressing step of pressing the water-added cloth under heat, each of the steps being performed while supporting the cloth on a belt running horizontally.

2. The method according to claim 1, further comprising a forced-cooling step performed while supporting the cloth on the belt running horizontally.

3. The method according to claim 1, wherein the water is added in the moisture controlling step so that the cloth contains an amount of water at least not smaller than normally contained therein at a room temperature, and a weight of the cloth is reduced in the temperature-holding step through the thermal pressing step, to 98~90% of a weight of the cloth in a normal state at the room temperature.

4. The method according to claim 1, wherein a temperature for the heating is 130° C.~180° C.

5. The method according to claim 1, wherein a pressure for the pressing in the thermal pressing step is 0.02 $kg/cm^2$~3 $kg/cm^2$.

6. The method according to claim 1, wherein the pressing operation is preformed while continuously increasing a pressure in the thermal pressing step.

7. The method according to claim 1, wherein a temperature and a length of time for the heating in the temperature-holding step through the thermal pressing step are selected for reduction of weight of the cloth to 98~90% of a weight in a normal state at a room temperature.

8. The method according to claim 1, wherein a temperature for the heating is 130° C.~180° C., and a length of time for the heating in the temperature-holding step through the thermal pressing step is 5 seconds through 120 seconds for reduction of weight of the cloth to 98~90% of a weight in a normal state at a room temperature.

9. The method according to claim 1, for stabilizing a cloth to which an interlining cloth is to be thermally bonded, wherein a temperature for the heating is higher than a temperature for the thermal bonding of the interlining cloth.

10. The method according to claim 1, for stabilizing a cloth to which an interlining cloth is to be bonded, wherein a temperature for the heating is higher by at least 10° C. than a temperature for the thermal bonding of the interlining cloth.

11. The method according to claim 1, for stabilizing a cloth to which finish pressing is to be performed, wherein a temperature for the heating is higher than a temperature for the finishing pressing.

12. The method according to claim 1, further comprising a stretch-and-shrinkage controlling step of removing stress, wrinkles and so on developed in the cloth, performed after the moisture controlling step.

13. An apparatus for stabilizing a cloth, comprising transporting means for transporting the cloth while supporting the cloth on a belt running horizontally;

moisture controlling means for adding water to the cloth being transported by the transporting means;

temperature-holding means arranged to heat the cloth and to maintain a temperature of the cloth; and thermal pressing means for thermally pressing the cloth being transported by the transporting means.

14. The method according to claim 13, further comprising forced-cooling means for forcibly cooling the cloth while supporting the cloth on the belt running horizontally.

15. The apparatus according to claim 14, wherein the belt is made of air-permeable material, and the forced-cooling means forcibly cools the cloth by passing room-temperature air or cooled air through the cloth and the belt.

16. The method according to claim 13, comprising a moisture controlling region provided with the moisture controlling means, a temperature-holding region in which the cloth is heated to and maintained at a temperature by heating means, a thermal pressing operation region in which the pressing operation is performed by pressing means while the cloth is heated to and maintained at a temperature, and a forced-cooling region in which the cloth is forcibly cooled by cooling means, the transporting means transporting the cloth sequentially to each other of the regions.

17. The apparatus according to claim 16 wherein the transporting means in the temperature-holding region and the thermal pressing operation region is a pair of sandwiching belts for holding and transporting the cloth by sandwiching from above and below, made of a material not permeable by steam, the heating means being an upper heater and a lower heater disposed along outward surfaces of the upper and lower belts respectively, and the pressing means applying pressure to the cloth via the upper and lower belts.

18. The apparatus according to claim 17, wherein the thermal pressing means is a pair of upper and lower pressing rollers disposed respectively above and below the sandwiching belts for applying pressure to the cloth via the upper and lower sandwiching belts.

19. The apparatus according to claim 18, wherein a plurality of pairs of upper and lower pressing rollers are provided continuously along the sandwiching belts.

20. The apparatus according to claim 17, wherein the thermal pressing means is a pair of upper and lower pressing plates above and below the sandwiching belts for applying pressure to the cloth via the upper and lower sandwiching belts.

21. The method according to claim 13, wherein the transporting means in the moisture controlling region includes a belt permeable by steam, and the moisture controlling means is a steam spraying device spraying steam to the cloth from above or below the steam-permeable belts.

22. The method according to claim 13, wherein the moisture controlling means is a water spraying device.

23. The method according to claim 13, wherein the pressing means continuously increases a pressure in a transporting direction of the cloth.

24. The method according to claim 13, further comprising stretch-and-shrinkage controlling means provided after the moisture controlling means provided after the moisture controlling means, for removing stress and wrinkles resulted from stretching and/or shrinking of the cloth.

25. The apparatus according to claim 24, wherein the stretch and shrinkage controlling means is a controlling bar draped by the cloth, for stretching the cloth widthwise.

26. A method for manufacturing a cloth, comprising a stabilizing process including a moisture-adding operation of adding water to the cloth, a temperature holding operation of heating the cloth while maintaining a temperature of the cloth, and a thermal pressing operation performed thereafter of pressing the cloth under heat, the operations being preformed while supporting the cloth on a belt running horizontally.

27. The method according to claim 26, wherein the cloth is forcibly cooled while the cloth is supported on a horizontally-running gas-permeable belt, after the pressing operation.

28. The method according to claim 26, wherein a temperature for heating the cloth is not lower than 130° C. and not higher than 180° C.

29. The method according to claim 26, wherein a pressure for pressing the cloth is 0.02 $kg/cm^2$~3 $kg/cm^2$.

30. The method according to claim 26, the cloth is to be bonded with an interlining cloth.

31. The method according to claim 30, wherein the temperature for pressing the cloth is higher than a temperature for bonding the interlining cloth.

* * * * *